US008202395B2

(12) United States Patent
Eriksson

(10) Patent No.: US 8,202,395 B2
(45) Date of Patent: Jun. 19, 2012

(54) METHOD FOR THE CREPING OF PAPER

(75) Inventor: Tore Eriksson, Klässbol (SE)

(73) Assignee: CS Produktion Antiebolag, Saffle (SE)

( * ) Notice: Subject to any disclaimer, the term of this patent is extended or adjusted under 35 U.S.C. 154(b) by 188 days.

(21) Appl. No.: 12/527,488

(22) PCT Filed: Jan. 24, 2008

(86) PCT No.: PCT/SE2008/050084

§ 371 (c)(1),
(2), (4) Date: Sep. 4, 2009

(87) PCT Pub. No.: WO2008/103115

PCT Pub. Date: Aug. 28, 2008

(65) Prior Publication Data

US 2010/0032112 A1 Feb. 11, 2010

(30) Foreign Application Priority Data

Feb. 22, 2007 (SE) ..... 0700453

(51) Int. Cl.
*B31F 1/12* (2006.01)

(52) U.S. Cl. ..... 162/111; 156/183; 264/283

(58) Field of Classification Search ..... 162/111–113, 162/280–281; 156/183; 264/282–283; 428/152–153; 15/256.51; 118/413
See application file for complete search history.

(56) References Cited

U.S. PATENT DOCUMENTS 2,664,792 A * 1/1954 Cook ..... 15/256.51
3,014,833 A * 12/1961 Lee ..... 162/111
3,065,486 A * 11/1962 Scott ..... 15/256.51
3,688,336 A * 9/1972 Costello et al. ..... 15/256.51
3,703,019 A * 11/1972 Bratt ..... 15/256.51
3,711,888 A * 1/1973 Dunlap ..... 15/256.51
3,778,861 A * 12/1973 Goodnow ..... 15/256.51
4,528,067 A 7/1985 Hedberg
4,691,406 A 9/1987 Goodnow
4,789,432 A * 12/1988 Goodnow et al. ..... 162/281
4,906,335 A * 3/1990 Goodnow et al. ..... 162/281
5,007,132 A * 4/1991 Reid et al. ..... 15/256.53
5,066,364 A * 11/1991 Goodnow et al. ..... 162/281
5,230,775 A 7/1993 Goodnow
5,403,446 A 4/1995 Trelsmo
5,507,917 A 4/1996 Didier
5,512,139 A * 4/1996 Worcester ..... 162/111
5,529,806 A * 6/1996 Eriksson ..... 427/356
5,674,361 A * 10/1997 Marinack ..... 162/111

(Continued)

FOREIGN PATENT DOCUMENTS

SE 505667 C2 9/1997

(Continued)

*Primary Examiner* — Jose A Fortuna

(74) *Attorney, Agent, or Firm* — Jeffrey S. Melcher; Manelli Selter PLLC

(57) ABSTRACT

A creping doctor device for the scraping off and creping of a running paper web from a rotating cylinder, comprising a holder device arranged to be able to support a continuous, or divided, longitudinally moveable doctor blade, which doctor blade is arranged to have a length that exceeds at least twice the length of said cylinder and is provided with a scraping surface and a contact line and/or contact surface, which contact line and/or contact surface is intended to bear against the jacket surface of said rotating cylinder at a certain linear load, said doctor blade comprising a supporting part and a wear part that is moveable in relation to the supporting part.

10 Claims, 5 Drawing Sheets

U.S. PATENT DOCUMENTS

| | | | | |
|---|---|---|---|---|
| 5,783,042 | A * | 7/1998 | Leeman et al. | 162/198 |
| 5,980,692 | A * | 11/1999 | Goodnow et al. | 162/281 |
| 6,120,649 | A | 9/2000 | Eriksson | |
| 6,207,021 | B1 * | 3/2001 | Eriksson et al. | 162/281 |
| 6,312,563 | B1 * | 11/2001 | Goodnow et al. | 162/281 |
| 6,328,853 | B1 * | 12/2001 | Goodnow et al. | 162/281 |
| 6,458,247 | B1 * | 10/2002 | Uuttana | 162/281 |
| 6,651,303 | B1 * | 11/2003 | Toivanen et al. | 29/407.02 |
| 6,687,950 | B1 * | 2/2004 | Rata et al. | 15/256.51 |
| 6,749,725 | B1 * | 6/2004 | Isometsa et al. | 162/281 |
| 6,786,999 | B2 * | 9/2004 | Goodnow et al. | 162/281 |
| 7,013,526 | B2 * | 3/2006 | Eskelinen et al. | 15/256.53 |
| D523,737 | S * | 6/2006 | Eriksson | D8/380 |
| 7,244,340 | B2 * | 7/2007 | Laithier et al. | 162/281 |
| 7,618,518 | B2 * | 11/2009 | Rata et al. | 162/280 |
| 7,713,384 | B2 * | 5/2010 | Bartelmuss et al. | 162/281 |
| 2001/0011401 | A1 * | 8/2001 | Rata | 15/256.51 |
| 2002/0040774 | A1 * | 4/2002 | Dennis, Jr. | 162/281 |
| 2002/0153114 | A1 * | 10/2002 | Brauns et al. | 162/281 |
| 2002/0174966 | A1 * | 11/2002 | Brauns et al. | 162/280 |
| 2002/0189777 | A1 * | 12/2002 | Rata et al. | 162/281 |
| 2006/0180291 | A1 * | 8/2006 | Rata | 162/281 |
| 2006/0185812 | A1 * | 8/2006 | Rotherham | 162/280 |
| 2006/0289141 | A1 * | 12/2006 | Rata et al. | 162/280 |
| 2007/0187057 | A1 * | 8/2007 | Bartelmuss et al. | 162/281 |
| 2009/0148208 | A1 * | 6/2009 | Gauvin et al. | 399/351 |
| 2010/0032112 | A1 * | 2/2010 | Eriksson | 162/111 |

FOREIGN PATENT DOCUMENTS

WO WO 2008103115 A1 * 8/2008

* cited by examiner 20
64
65
72
73B
91”
73A
71’

20
64
73B
91
91”
65
73A
71’
9
91’
74
71
78
77
7
92

METHOD FOR THE CREPING OF PAPER

CROSS-REFERENCE TO RELATED APPLICATIONS

This application is a national stage entry under 35 U.S.C. 371 of International Application No. PCT/SE2008/050084, filed 24 Jan. 2008, designating the United States. This application claims foreign priority under 35 U.S.C. 119 and 365 to Swedish Patent Application No. 0700453-4, filed 22 Feb. 2007.

TECHNICAL FIELD

The present invention relates to a device and a method for the scraping off and creping of a running paper web from a rotating cylinder, comprising suspension means, a holder device arranged in said suspension means and arranged to support a continuous, or divided, longitudinally moveable doctor blade, which doctor blade has a length that exceeds at least twice the length of said cylinder and is provided with a scraping surface and a contact line and/or contact surface, which contact line and/or contact surface is intended to bear against the jacket surface of said rotating cylinder at a certain linear load.

BACKGROUND

When producing soft paper, such as toilet paper, household paper, napkins and similar hygiene products, the softness and absorbency of the paper is usually achieved by a so called creping method. In this method, the still wet fibre layer/web produced in the forming of the paper is led onto a drying cylinder and the finally dried or partially dried web is scraped off and pulled off on an exit side of the cylinder, after which it is led on to subsequent optional additional drying and/or reeling. In the line of trade, such drying cylinders are called "Yankee cylinders". These cylinders are characterised by their large diameter which is between 3 and 5 metres. The drying of the paper web takes place by the contact with the hot surface that usually is heated by internal supply of steam and by external supply of hot air.

Hence, the so called creping takes place in the above mentioned web transfer (scraping off). In this process, the running web is "scraped off" from the cylinder by a so called counter blade that with a certain pressure bears against the cylindrical surface. By the running web meeting the blunt surface of said blade, a micro-crinkling of the web/paper takes place. This micro-crinkling that accordingly is called creping, increases the thickness and the softness of the paper. A prerequisite for creping to take place is that the running web exhibits a certain adhesion to the cylindrical surface. This adhesion can be natural, by the paper not being completely dried, or by the fibre composition of the paper containing components that adhere to the cylindrical surface. A common way of achieving the desired adhesion is to externally supply adhesive agents to the cylindrical surface. Usually, this takes place by spraying the adhesive substance at low concentration onto the cylindrical surface.

Hence, the active machine component in the creping process is a counter blade, a so called creping doctor that with a pressure bears against the cylindrical surface and the blunt surface of which scraping off and micro-crinkling the paper. The creping doctor is arranged in a holder that has the following main functions:

Achieving a controllable bearing pressure for the creping doctor against the cylindrical surface.

Enabling engaging and disengaging of the creping doctor.

Enabling fast exchanging of the creping doctor.

The contact between the creping doctor and the cylindrical surface results in wear of the creping doctor as well as the cylindrical surface. This results in negative process consequences in the form of wear. For the creping doctor, the consequences of the wear is that it has to be exchanged, which besides the cost of the creping doctor means considerable costs for production loss in connection with the exchanging. For the cylindrical surface, the consequences of the wear is that every now and then the surface must be re-ground, which is costly. Since the cylinder is a pressure vessel, the cylinder must also have a certain jacket thickness. This means that the cylinder must be redressed with a new wearing surface after a certain number of re-grindings. Another consequence of the creping doctor wear is that the quality of the crepe paper changes with the level of wear.

In order to keep down the wear it is important to maintain a pressure that is as small as possible between the tip of the creping doctor and the cylindrical surface. A certain minimum pressure must however be maintained in order to prevent the paper web, or parts of the paper web, from passing between the creping doctor and the cylindrical surface, which otherwise results in web break.

The most common way of achieving a desired creping doctor pressure is to rotate the holder about its axis of suspension. Due to the rotation, the creping doctor will bend more or less and thereby it will apply a resilient pressure against the cylindrical surface. The drawback of this solution is that the bearing pressure cannot be increased with the wear since the creping doctor is flexible and its bending increases with the pressure, which in turn results in the contact surface against the cylinder at a certain pressure level forming an open wedge, which in turn increases the risk of the web getting caught and thus causing web break.

Said drawback can be eliminated by a device that is described in Swedish patent no. SE 505,667. This device enables the pressure to be changed without changing the contact angle of the creping doctor against the cylindrical surface. This is achieved by separate pressure means that act near the tip of the creping doctor, whereby the creping doctor is not bent in connection with the pressure change. Thereby, the time intervals between changes of the creping doctor can be prolonged, i.e. its lifespan increases.

The lifespan of the creping doctor can also be increased by the tip of the doctor and the contact surface against the cylinder being coated with a material that is harder than the actual basal body of the creping doctor. An example of this solution is described in GB 2,128,551. The problem with this solution is that it is easier for the harder material to damage the cylindrical surface, such as by wear.

In order to decrease the wear of the cylindrical surface, the substance that increases the adhesion of the paper web against the cylindrical surface can be combined with a substance that builds up a layer on the cylindrical surface. Hereby, the tip of the creping doctor will "scrape" in the built-up layer instead of "scraping" against the cylindrical surface. The drawback of this method is among other things a high chemicals consumption and impaired heat transport through the cylinder and that chemical residues are mixed into the paper.

Although the running times for the creping doctors can be increased by the above mentioned methods, the creping doctor must nevertheless be exchanged after production intervals of more or less length. It has been tried to diminish this problem by continuously feeding a traditional long creping doctor in its longitudinal direction. The method is described in U.S. Pat. No. 4,691,406. Some, of several, problems that have prevented the method from establishing on the market is that the construction requires costly maintenance, that the adjustment possibilities are limited, that the method requires large space on both sides of the machine, and that the doctor blade consumption is high because the feeding speed needs to be high enough for the difference in wear on the incoming and exiting sides not to result in quality differences between the two sides.

BRIEF ACCOUNT OF THE INVENTION

The primary objective of the present invention is to decrease the production loss due to among other things blade change, and preferably also to decrease the wear of the cylinder and preferably also to decrease the need of the chemicals that reduce the wear of the cylinder, which is achieved by a method according to claim 1.

Thanks to the invention, a cost efficient design is achieved that also results in good adjustment abilities, and many advantages are attained, primarily in the form of less production stops, but also in the form of cost savings related to doctor blade costs and re-grinding of the drying cylinders.

According to further aspects of the invention:

- the cross-sectional area of said doctor blade is 2-75 $mm^2$, preferably 3-50, more preferred 5-30 $mm^2$, which results in the advantage that the cost of the wear part, i.e. the doctor blade, can be considerably reduced, especially since the doctor blade is made of a material that is considerably much cheaper than traditional durable materials such as different types of metal alloys (e.g. steel, bronze, brass, aluminium alloys, copper alloys, titanium alloys, temperature resistant polymers (such as PTFE, etc.)).
- said doctor blade is lodged to slide in a supporting/holder part that projects from the holder device, which gives the advantage that it is easy to keep the cross-sectional area of the exchangeable doctor blade at a low level, thanks to the ability of minimizing its cross-sectional area by aid of the projecting holder part.
- said supporting part is provided with a pivotal hinge that extends essentially in parallel with said doctor blade, said hinge preferably being resilient, resulting in the advantage that it is easy for the doctoring device to maintain good creping/scraping also at relatively large wear of the doctor blade, by the possibility to angle the doctor blade along the extension of the cylinder.
- a pressing device is arranged to achieve the above mentioned linear load by said contact line and/or contact surface, resulting in an increased possibility of flexible and cost-efficient control of the line load in order to optimize creping and scraping.
- said pressing device comprises a body that is pivotal about a fulcrum, which body is anchored in the holder device and which pressing device comprises a pressing part and a pressurizing means, said pressing part preferably being at least partly divided, whereby independent pressing parts are achieved adjacent each other, resulting in the advantage that a relatively simple and easy to control pressing device can be achieved.
- said holder device is anchored at an elongated anchoring member, the fixing means of which being arranged to allow for a displaced positioning of the centre line of said anchoring member in respect of the distance to the cylindrical jacket surface, resulting in the advantage that it is easy and cost-efficient to compensate for wear of the doctor blade, while maintaining a good scraping and creping effect.

A preferred embodiment of the invention is based on the following principle: The creping doctor device consists of two parts. A supporting part and a doctor blade part. The supporting part consists of a stable material such as steel housing a guide for the doctor blade that is lodged to slide in the supporting part. Said doctor blade is preferably produced from a material that has considerably less wear effect on the cylindrical surface than does traditional materials (such as in the form of materials of less wear resistance than the cylindrical surface) which results in that the creping doctor will act gently on the cylindrical surface. The rear part of the creping doctor is the consumption part of the unit. In order to minimize the material costs of said doctor blade, the cross-sectional area is small. This will also give the advantage that large lengths of the doctor blade can be stored as a reel. The cross-sectional area of said active doctor part is 5-75 $mm^2$ and in a preferred embodiment 10-30 $mm^2$, the thickness being between 3 and 0.3 mm, preferably between 2 and 0.5 mm, more preferred 1.5-0.6 mm.

Decreased down times for the exchanging of blades are achieved by the active doctor part having a length that is considerably much longer than the length of the cylinder, and that said active part is continuously movable in its longitudinal direction. The above mentioned length of the doctor blade is 2 to 150 times the length of the cylinder. In a preferred embodiment of the invention, the length is between 10 and 50 times the length of the cylinder, the length of such a cylinder usually being 4-5 metres, lengths of up to 7 metres however being known, which roughly gives the range 8-700 m. In principle however, there is no real limit in the maximum length other than space/manageability.

BRIEF DESCRIPTION OF THE DRAWINGS

The technical construction of the creping system will now be described by an embodiment example with reference to the appended drawings, of which.

DETAILED DESCRIPTION

Figure 1:
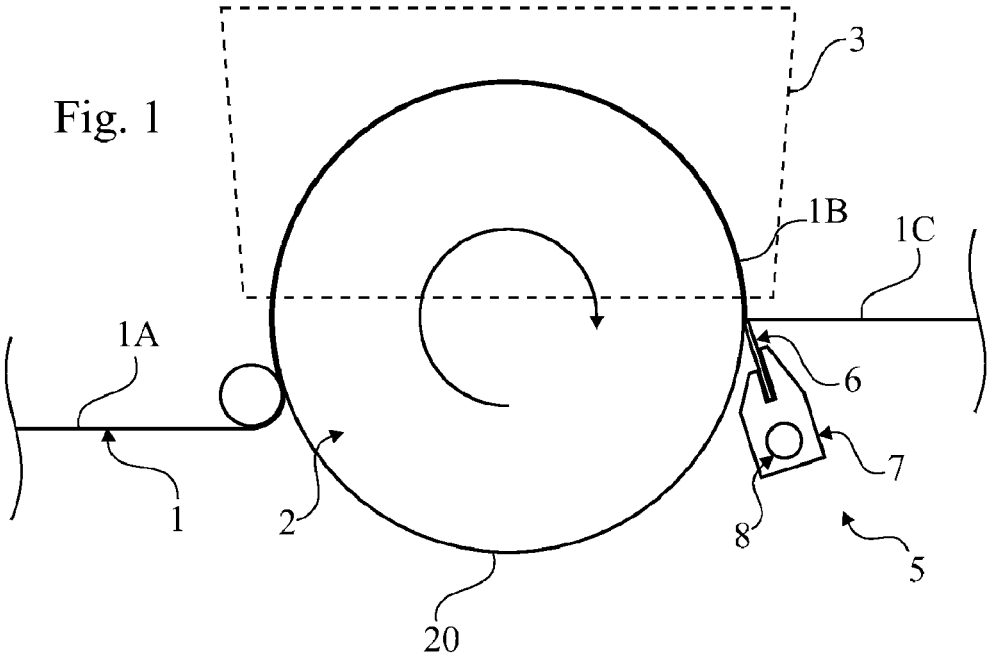
FIG. 1 schematically shows the principles of a creping doctor according to the invention.
Figure 2:
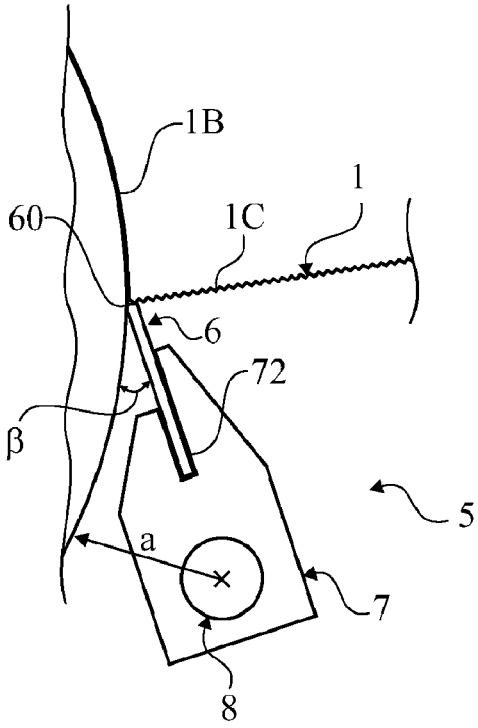
FIG. 2 shows a magnification of a part of FIG. 1.

FIGS. 1 and 2 show the principles of the production of crepe paper according to the invention. A paper web 1 is shown in the form of an incoming moist fibre web IA that in a traditional manner is led onto a drying cylinder 2, e.g. in the form of a so called Yankee cylinder, that has a heated jacket surface and at which a hot air dryer 3 is arranged. The finally dried or partly dried web 1B is scraped and pulled off from the outlet side of the cylinder 2, by aid of a creping doctor device 5. The scraping off is achieved by a counter-acting doctor blade 6 that with a certain pressure bears against the surface 20 of the cylinder 2. The creping doctor device 5 comprises an elongated holder part 7 and an anchoring part 8. The holder device 7 is provided with a longitudinal groove (in the form of a slot of adequate depth and width in order to provide satisfactory support and guiding and at the same time to allow for sliding) 72 that either has enough width for the doctor blade to be pulled out and pushed in when being exchanged and/or is provided with means that allow for setting the height and/or width, which positions the doctor blade 6 in the holder device 7. In its turn, the holder device 7 is rotatably anchored at the anchoring part 8 that according to a preferred embodiment consists of an elongated part of cylindrical outer jacket surface. Suitable fixing means/locking means (not shown) are provided in order to fix the holder device 7 in a certain given position in relation to the anchoring part 8. By turning the holder device 7 about the anchoring part 8, the doctor blade 6 can be moved to and from the jacket surface 20 of the roll 2, and moreover a adjustable bearing pressure of the doctor blade 6 against the surface 20 of the roll 2 can be achieved.

FIG. 2 shows that it is the blunt end 60 of the doctor blade 6 that achieves a micro-crinkled web 1C when contacting the web 1B that is led towards the blunt end 60 by aid of the rotation of the cylinder 2.

Figure 3:
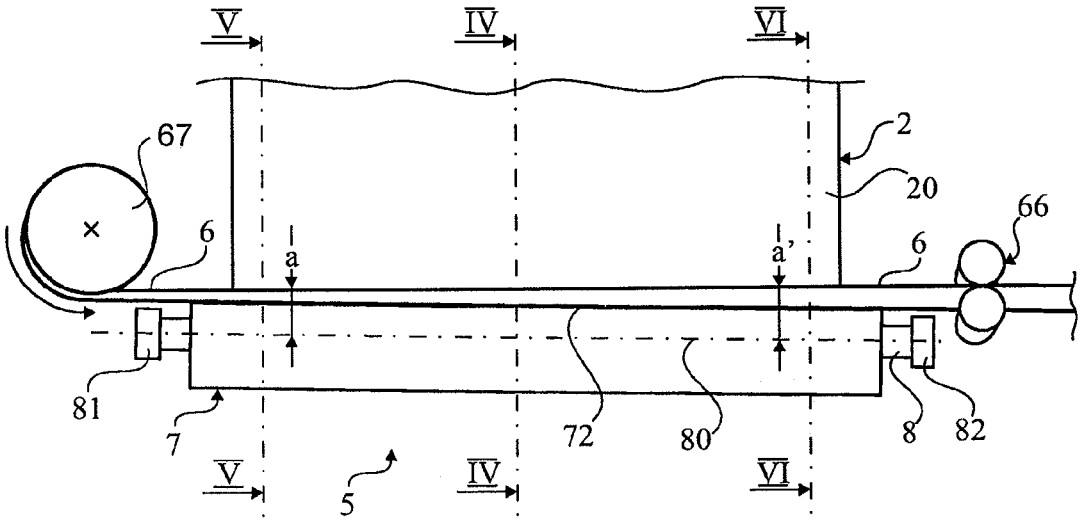
FIG. 3 shows a view from above of a creping doctor according to the invention.

FIG. 3 schematically shows a view from above over a creping doctor device according to the invention. As is shown in the figure, the doctor blade 6 is arranged on a reel 67 that is arranged in connection with the inlet side of the doctor device 5. The doctor blade 6 is continuously fed from the reel 67 and into the groove 72 in the holder device 7, by aid of capstans 66 arranged in connection with the outlet side of the creping doctor device 5. It is also clear from the schematic view in FIG. 3 that the anchoring part 8 is displaced such that it forms an angle in relation to the line formed by the jacket surface 20. Accordingly, the distance between the centre line 80 forms a shorter distance a in the vicinity of the inlet side of the creping doctor device 5 and a longer distance a' in the vicinity of the outlet side of the doctor device 5. This is achieved by the arrangement of suspension means 81, 82 that enable adjusted positioning of the anchoring part 8, at least in respect of its position in a horizontal plane. (In certain embodiments, the creping doctor device can be connected as is known per se (see e.g. SE 505,667) to a machine stand that has a second centre of rotation that coincides with the contact point between the creping doctor and the cylinder 2.) By this embodiment, the adjustment of the angle β of the doctor blade against the cylindrical surface is facilitated.

Thanks to this positioning of the anchoring part 8 a contact between the doctor blade 6 and the jacket surface 20 can be achieved which allows for a changed angle β along the extension of the roll 2, which is an arrangement according to a preferred embodiment of the invention and will be explained in greater detail below, in connection with FIGS. 4-8.

The doctor blade 6 is fed in its longitudinal direction at a speed that is adapted such that the creping quality is satisfactory also at the outlet side of the doctor blade, despite the fact that a certain wear—that is larger than on the inlet side—has taken place. The doctor blade 6 that is guided in the groove 72 in the supporting part of the creping doctor device, is fed by capstans 66 that press against the doctor blade 6. Downstream the capstans 66, the consumed doctor blade is cut into small pieces or is reeled up (such as to be used again, optionally after being treated). The capstans 66, the stock reel 67 and the collection device (not shown) are suitably connected to the doctor device 5 in such a way that they follow the movements of the holder device 7. In order to achieve an optimum balance between wear and speed, the driving speed is preferably variably adjustable. The control of the driving arrangement suitably also includes a function for fast feeding to be used e.g. in case a damaged part of the doctor blade needs to be fed out from the working area.

Figure 4:
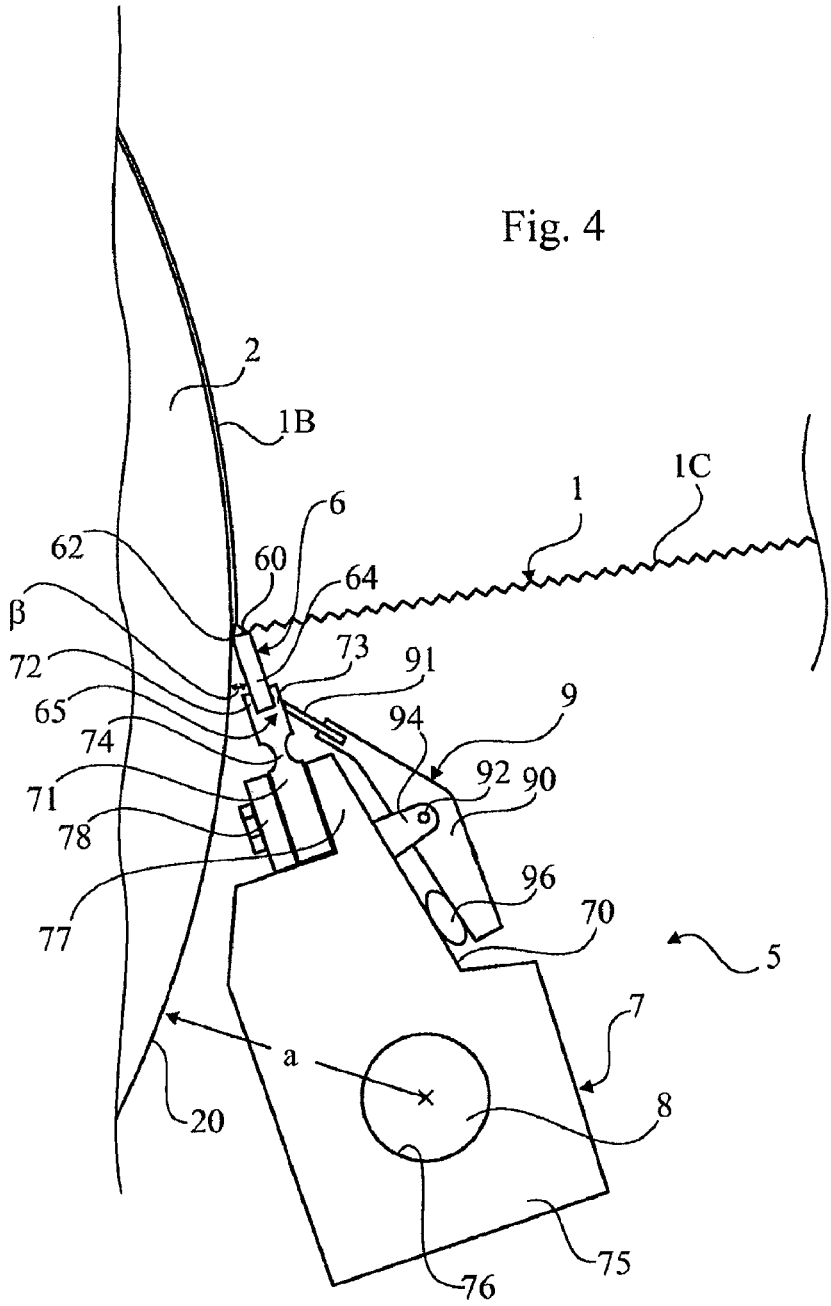
FIG. 4 shows a side view over a doctor unit according to a preferred embodiment of the invention.

FIG. 4 shows a side view over a creping doctor device 5 according to one embodiment of the invention, which as above is rotatably suspended in the anchoring part 8, preferably here by shaft journals. By the rotational movement, the creping doctor device 5 is positioned in a working position and a disengaged inactive position, respectively. The creping doctor device comprises a holder device 7 consisting of an elongated body 75 with anchoring means (such as circular recesses) 76 intended for said shaft journals. At the upper portion of the body there is a lip 77 at which a holder part 71 is clamped by a mechanical joint 78. This holder part 71 forms a type of basis for a preferred principle according to the invention, in which the object defined as the doctor blade 6 consists of two parts, the supporting part 65 and the wear part 64, respectively. With the purpose of enabling optimal use of this principle, there is a connecting means which is a pivotal hinge 74 between the holder part 71 and an upper part 73 of the supporting part 65, here in the form of a waist 74 that forms a pivotal resilient hinge. The upper end of the upper part 73 of the supporting part 65 is provided with an elongated groove 72 intended to position the sliding part of the doctor blade, i.e. the wear part 64. By pivoting the portion above the pivotal hinge 74, the contact of the doctor blade 6 against the jacket surface 20 can be provided at different angles R. On the other side (in relation to the position of the holder part 71) of said lip 77, there is a surface 70 at which a pressing device 9 is arranged.

The pressing device 9 consists of an elongated body (or a body that is divided/sectioned in its longitudinal direction) 90, with a cross-sectional shape approximately as a banana and which at about the middle of said body is pivotal about a pivot point 92. The pivot shaft 92 is supported by bracket members 94, such that the body can pivot about a horizontal axis that extends in parallel with the holder device 7. At the upper end of the pressing body there is a pressing member 91 (that may be elongated or in sections) the end of which bears against the supporting part 65 along a line above said fulcrum 74, such that pressing by aid of the pressing member 91 can affect a pivoting of the doctor blade 6, i.e. the supporting part 65 with the wear part. The pressing load can be applied by one or more pressure means 96 (preferably a flexible inflatable hose) that is arranged between the lower portion of the body 90 and the surface 70 of the holder device 7. Hence, the pressing load can be controlled by aid of said pressurizing means 96, by it pivoting the body 90 about the pivot hinge 92 such that the pressing member 91 affects the pressing load of the doctor blade against the jacket surface 20 at its contact line 62. The wear part 64 is axially moveable, that is lodged to slide inside the slot 72 in the supporting part 65. The pressing member 91 suitably consists of a split section, such that tightly fitting resilient fingers 91 are formed that exert a pressure on the supporting part 65. Thanks to the resilient properties of the fingers, a uniform pressure is formed over the entire length of the cylinder, despite the fact that a cylinder 2 may vary in straightness due to crowning and steam pressure.

Figure 5:
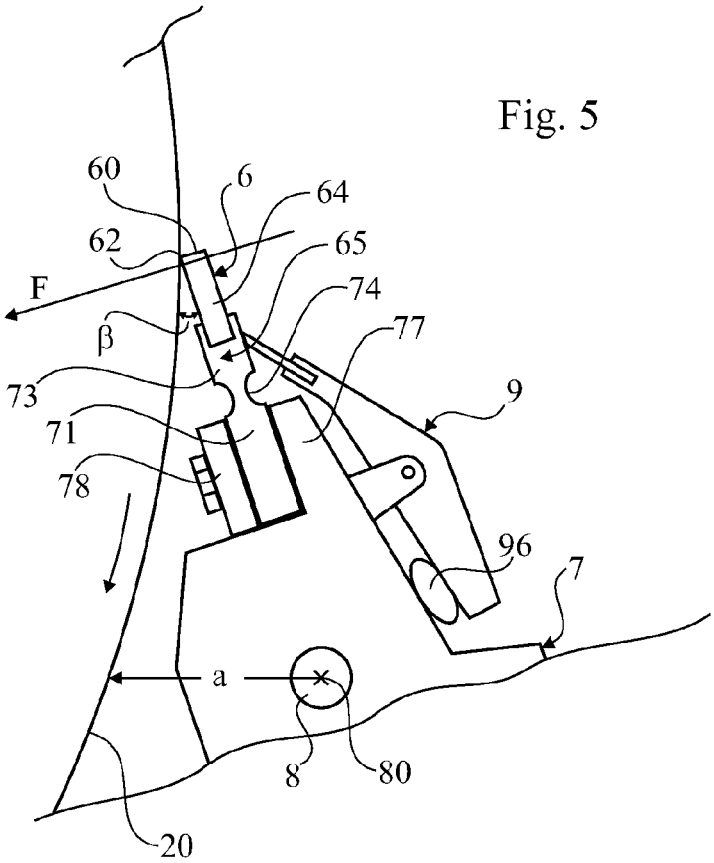
FIGS. 5 and 6 show side views over the contact surfaces of a creping doctor according to the invention, at the inlet and outlet sides, respectively.
Figure 6:
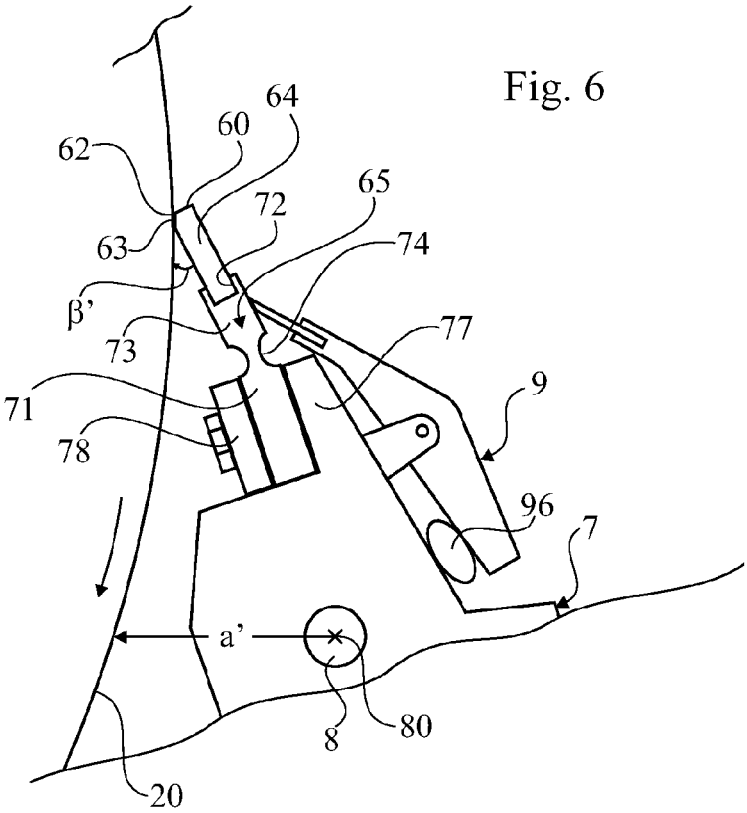

FIGS. 5 and 6 show a magnification of the area around the contact line/point 62 between the cylinder 2 and the doctor blade 6, where FIG. 5 shows the appearance of the contact point for a non worn doctor blade 6 (i.e. the wear part 64) and FIG. 6 shows the corresponding situation for a worn doctor blade 6. It is also an object of the invention that the doctor blade should be gentle to the cylindrical surface 20. To achieve this, the material of the doctor blade 6 can, according to one embodiment, be less durable than the cylindrical surface 20. Thereby, the contact point 62 between the doctor blade and the cylindrical surface at the inlet side of the doctor blade (non worn) will resemble an edge according to what is shown in FIG. 5, while the contact point develops to a surface 63 (worn) on the outlet side, according to FIG. 6. At a constant linear load F, this situation would lead to a lower contact pressure per unit of area on the outlet side, which may negatively affect the scraping effect. FIG. 6 shows a way of compensating for said negative effect by a certain tilting of the anchoring part 8 (the doctor blade holder) such that the distance a between the centre line 80 and the cylindrical surface 20 will be larger on the outlet side a' than on the inlet side a, i.e. a'>a. By said tilting, the angle β between the doctor blade 6 and the cylindrical surface 20 will increase gradually from the inlet side to the outlet side, thus resulting in the beneficial effect that the compressive load F is not distributed over a worn surface 63 but is concentrated to the tip 62 of the worn surface. By this method, the scraping effect will be more uniform over the length, thus resulting in a longer life span for the doctor blade 6.

Figures 7, 8:
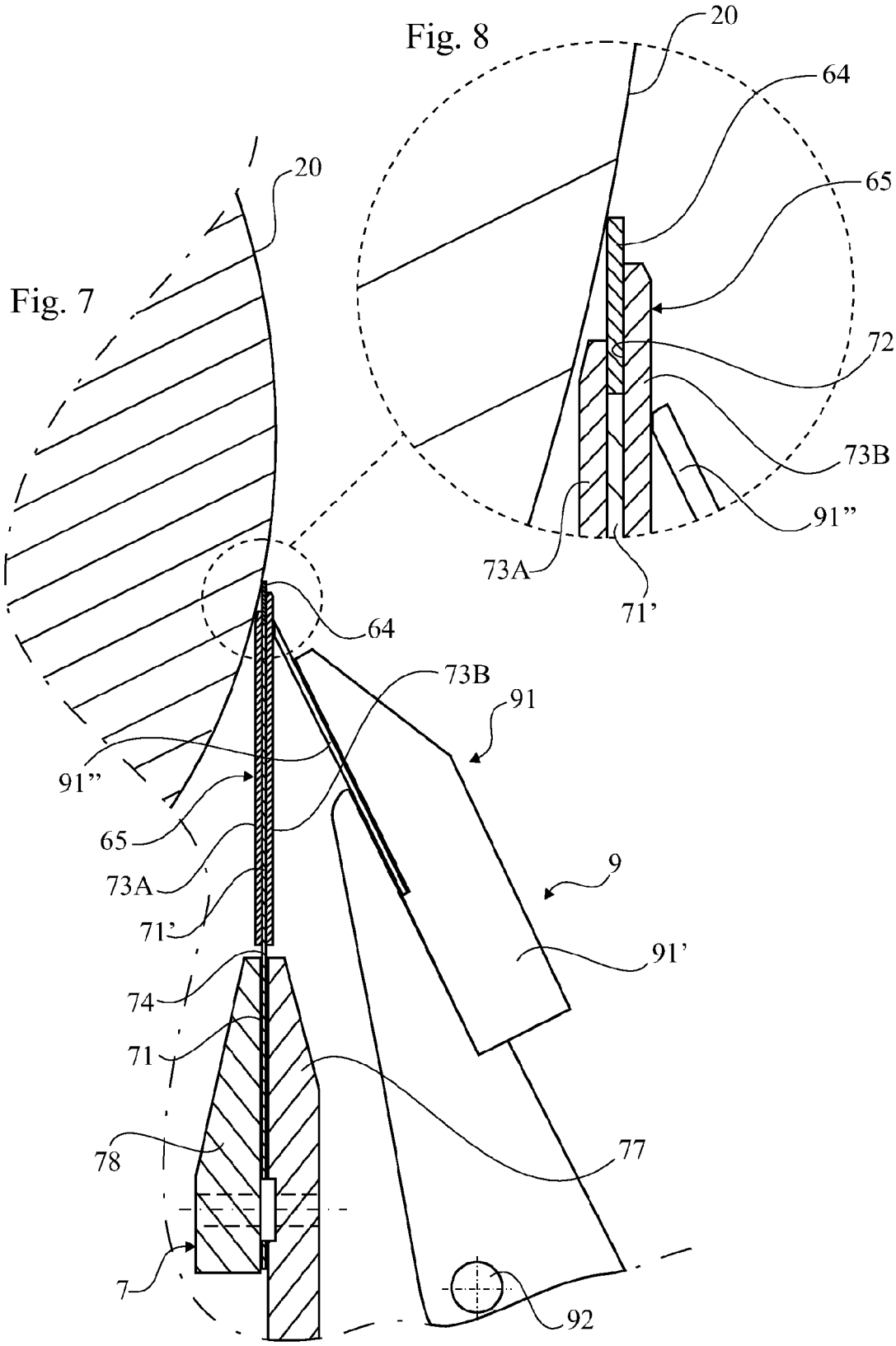
FIGS. 7 and 8 show side views over a preferred embodiment of a creping doctor according to the invention.

FIG. 7 and the part magnification in FIG. 8 are shown in a preferred embodiment of a creping doctor arrangement according to the invention. The principles are basically the same as described above, e.g. in connection with FIG. 4. In the following description the focus will therefore primarily be on differences in relation to FIG. 4. FIG. 7 that shows a cross-section in a side view, illustrates that the holder part 71 clamped in the holder device 7 is relatively thin (preferably 0.5-2 mm) and projects above the lip 77 in the same cross-sectional shape as the clamped part. In addition, this part of the material extends further in the upwards direction, thus forming an upper portion 71' that extends relatively close to the surface 20 of the roll 2. At a certain distance above the end of the lip 77 and on either side of said upper portion 71' plate-shaped members 73A, 73B are arranged, such that a hinge 74 naturally forms in the area below the lower ends thereof (that are at the same level) in the portion of the material that constitutes the bridge between the actual holder part 71 and its upper portion 71'. At the top, the plate-shaped members 73A, 73B extend beyond the upper portion of the upper portion 71', such that a groove 72 forms at the top between the plates 73A, 73B. Thus, the plate-shaped members 73A, 73B, together with said upper portion 71', form the upper part 73 of the supporting part 65. In the groove 72, the moveable wear part 64 of the doctor blade 6 is then arranged.

This preferred embodiment accordingly achieves the hinge 74 as well as the groove 72 in a very cost-efficient way. The outer plate-shaped member 73B is advantageously arranged to extend further up than the inner member 73A, whereby a more narrow angle β can be used and/or a wear part 64 of lower height (the same principle applies also according to FIG. 1). Besides this, it is realised that the function is essentially the same as has been described above. It can be noted however that in this embodiment the pressing device 9 has a pressing member 91 that is divided into two elements, namely a base part 91' having the function of fixating and supporting the pressing member 91", and second part of the pressing member 91" that is clamped between said base part 91' and the front portion of the pressing device, which pressing member 91" forms the actual force-transmitting part.

The description above concerns the exemplified embodiments of the invention. Many varying embodiments may however exist within the scope of the invention.

The person skilled in the art will for example realise that there are many different ways of arranging the elongated doctor blade, in other ways than that described above. It is e.g. possible to arrange the doctor blade as an elongated loop, i.e. a doctor blade the ends of which has been joined together (e.g. by welding) and for which a continuous feeding of the doctor blade can take place without change until the wear has progressed too far for re-use to be possible. (In such a method it is possible to turn the doctor blade half a turn (i.e. 180°) such that when an already used scraping surface 60 returns to the inlet side it will be turned downwards in the groove 72. In this way, exactly the same settings can be used as for the previous "lap", since the cross-sectional width of the doctor blade is still exactly the same.) It is also conceivable to use the just mentioned arrangement and also to include some type of machining in order to renovate the surface 60, such as by milling, grinding and/or planning units. Such units could beneficially be integrated in the holder device 7 since the creping method automatically creates a counter-pressure that can ensure optimum bearing/contact at the place of machining. In such a method, some type of height adjustment mechanism is suitably also arranged, which for each machining compensates such that the entire holder device 7 (or just the projecting holder part 71) is fed successively upwards at the same rate that the width of the doctor blade is decreased by the machining. Another type of conceivable machining in such a method is heat treatment that can remelt and reshape, and optionally add material, such that when re-entering the doctor blade 6 has exactly the same cross-sectional shape as before the wear.

Another modification within the scope of the invention is for the doctor blade 6 to be of composite structure, i.e. to consist of several types of material that are combined, e.g. such that only a corner zone of the doctor blade 6 consists of the less abrasive material (e.g. softer and/or more hard wearing), e.g. in the form of a steel skeleton that has a suitable cross-sectional shape and surface structure in order for a polymer to be applied thereon, which polymer is suited for scraping and creping. The applicant reserves the right to file divisional applications relating to modifications disclosed in the present application, such as apparatus claims that protect the principle according to the independent method claim without limitation to "doctor blade split in two" (wear part 64 and supporting part 65, respectively). The person skilled in the art will also realise that the process costs are not only controlled by the purchase price of the material but that parameters such as decreased feeding rate, decreased production loss, simplified handling (including handling of waste product), etc., can contribute to decreased process costs.

It is also realised that the groove 72 can be lodged to slide in many different ways, such e.g. simply by being made of a material (e.g. PTFE) that allows for good sliding of the doctor blade 6 and/or by arrangement of a certain type of lubricant in the groove and/or by arrangement of special bearing arrangements (e.g. roller bearings) and optionally also that the width and depth of the groove in certain applications beneficially can be arranged to be adjustable. It is also realised that the holder part 71 can be arranged in varying ways, either to form a separate part such as is described above or to form a part that is integral with the holder device 7. In the same way, the pivotal hinge 74 can be arranged in various ways that are known per se, e.g. to form an individual part of its own, by principles known per se. Similarly, the pressing device can be varied in many different ways, such as by being divided as such with or without a divided pressing part 91 and/or as is indicated with reference to FIGS. 1 and 2 by arranging the pressing to be integral with the holder device 7 itself, i.e. to have a divided holder device 7 that by aid of the anchoring part 8 can be turned/positioned to achieve different types of pressing forces/positioning angles, respectively, along the extension of the cylinder. Finally, it is realised that in a corresponding manner, many other parts included in or employed in connection with the invention described above, can be modified in many different ways, such as the fixing means 81, 82 for the anchoring part and also the design of the anchoring part that naturally may be of many other cross-sectional shapes than the ones described above.

The invention claimed is:

1. A method for the scraping off and creping of a running paper web, comprising:

running a web onto and around a rotating cylinder; and scraping the web off the rotating cylinder using a creping doctor device comprising suspension means supporting a holder device supporting a longitudinally moveable counter-positioned doctor blade, the doctor blade having a length that exceeds at least twice the length of said cylinder and the doctor blade having a scraping surface that bears against a jacket surface of said rotating cylinder at a contact line and/or contact surface and the contact line and/or contact surface bears against the jacket surface at a certain linear load, the doctor blade having a separate supporting part and a wear part that is moveable in relation to the supporting part, said doctor device having a holder part that is detachably fixed in relation to the holder device, a pivotal hinge joining the holder part and the supporting part, wherein the pivotal hinge extends essentially in parallel with the doctor blade, and a pressing device acting upon the supporting part to provide the linear load by the contact line and/or said contact surface.

2. A method according to claim 1, wherein the doctor blade bears against said jacket surface at an angle that varies along its extension.

3. A method according to claim 2, wherein the contact angle is larger at the outlet side than said angle at the inlet side, in which said contact angle is larger than said angle.

4. A method according to claim 2, wherein the doctor blade applies torsion along its extension by changing the positioning of said holder device in interaction with said pressing device that achieves said desired linear load and desired said angle.

5. A method according to claim 1, further comprising after use and at a position downstream a driving device, cutting at least the wear part of said doctor blade into small pieces.

6. A method according to claim 1, wherein said wear part of said doctor blade comprises at least one of steel, bronze, brass, aluminium alloys, copper alloys, titanium alloys, and temperature resistant polymers.

7. A method according to claim 1, wherein the cross-sectional area of said wear part is 3-50 $mm^2$.

8. A method according to claim 1, wherein the cross-sectional area of said wear part is 5-30 $mm^2$.

9. A method according to claim 1, wherein said hinge is a part that is integral with the holder part.

10. A method according to claim 1, wherein the length of said doctor blade is 10-50 times the length of the cylinder.

* * * * *